United States Patent [19]

Armato

[11] Patent Number: 4,756,222

[45] Date of Patent: Jul. 12, 1988

[54] MUSICAL CONTAINER

[75] Inventor: Michael Armato, Crystal Lake, Ill.

[73] Assignee: Olive Can Company, Chicago, Ill.

[21] Appl. No.: 814,834

[22] Filed: Dec. 30, 1985

[51] Int. Cl.[4] ..... A45C 11/00; G10H 1/00; G10H 5/00

[52] U.S. Cl. ..... 84/1.01; 84/1.28; 200/308; 206/314; 446/397; 340/321; 340/328; 340/384 E

[58] Field of Search ..... 84/1.01, 1.18, 94 R, 84/94 C, 95 R, 95 C, 94.1, 94.2, 95.1, 95.2; 206/232, 307, 312–314; 446/297, 397, 418; 200/159 R, 308, 314; 340/321, 328, 331, 384 E

[56] References Cited

U.S. PATENT DOCUMENTS

| | | | |
|---|---|---|---|
| 4,035,948 | 7/1977 | Fishbein | 84/95 C X |
| 4,067,522 | 1/1978 | Williams | 340/328 X |
| 4,090,185 | 5/1978 | Patty | 340/321 |
| 4,193,065 | 3/1980 | Bittner | 340/321 X |
| 4,224,602 | 9/1980 | Anderson et al. | 340/321 |
| 4,466,327 | 8/1984 | Hinton | 84/95 C |
| 4,525,878 | 7/1985 | Lowe, Jr. | 84/94 C X |
| 4,537,109 | 8/1985 | Sakurai | 84/1.18 X |
| 4,546,245 | 10/1985 | Cooper et al. | 84/1.18 X |
| 4,607,747 | 8/1986 | Steiner | 84/94 C X |
| 4,628,791 | 12/1986 | Phipps | 84/94 C |
| 4,686,504 | 8/1987 | German | 340/328 |
| 4,698,621 | 10/1987 | Masot | 200/308 X |

*Primary Examiner*—Stanley J. Witkowski
*Attorney, Agent, or Firm*—Jenner & Block

[57] ABSTRACT

A knob for attachment to a removable lid of a container, the knob containing a selectively actuatable music module. The knob serves both a utilitarian function, as a means for removing a lid from a container, and an entertainment or advertising function, by playing a preprogrammed message. Either function may be utilized separately or in combination as the user selects.

6 Claims, 2 Drawing Sheets

MUSICAL CONTAINER

FIELD OF THE INVENTION

This invention relates generally to a removable container lid having a knob attached to the lid. The knob contains a selectively actuatable electric module capable of playing a preprogrammed tune when pressure is applied to the knob.

SUMMARY OF THE INVENTION

The present invention provides a novel knob attached to a removable container lid. The knob is configured to contain a miniaturized electronic music module. The knob, therefore, performs two functions. The first function is utilitarian: the knob provides a convenient hand grip on which a pulling pressure may be applied to remove a canister lid from a canister. The second function is that of providing a preprogrammed advertising message, jingle, or entertaining music from the music module within the knob when a module activation pressure is applied to the knob.

It is, therefore, a general object of the invention to provide a novel cannister knob capable of serving both a utilitarian function and an advertising or entertainment function simultaneously or independently at the user's option.

Other features, objects, and advantages of the present invention will become apparent upon reading the following detailed description and upon reference to the drawings. Throughout the drawings, like reference numerals refer to like parts.

DETAILED DESCRIPTION OF THE PREFERRED EMBODIMENT

While the invention will be described in connection with a preferred embodiment, it will be understood that it is not intended to limit the invention to this embodiment. On the contrary, it is intended to cover all alternatives, modifications and equivalents as may be included in the spirit and scope of the invention as defined by the appended claims.

Figure 1:
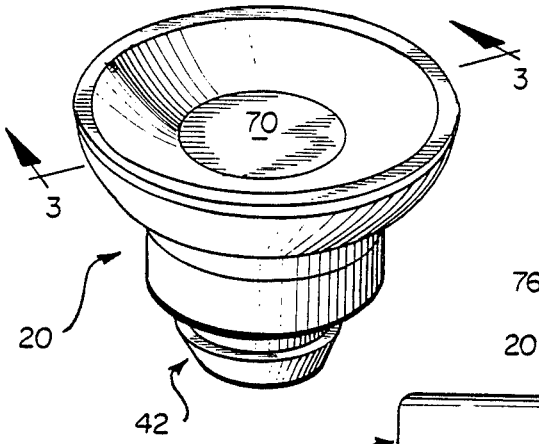
FIG. 1 is a perspective view showing a preferred embodiment of a novel knob containing a music module as it appears prior to attachment to a removable container lid.
Figure 2:
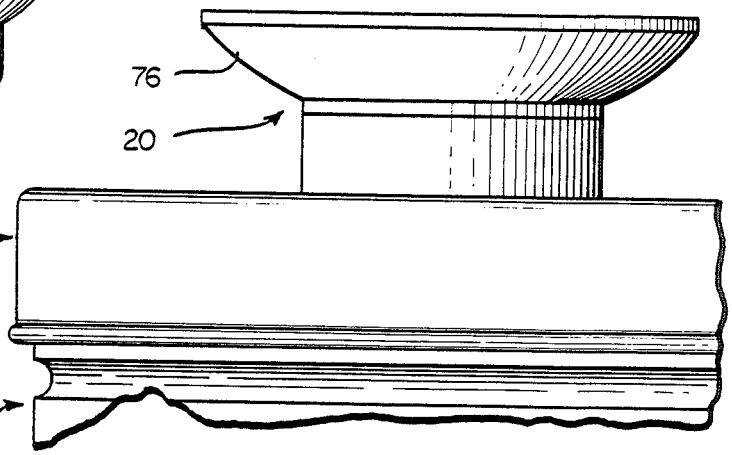
FIG. 2 is a fragmentary front plan view showing the novel knob as it appears when attached to a removable container lid.
Figure 3:
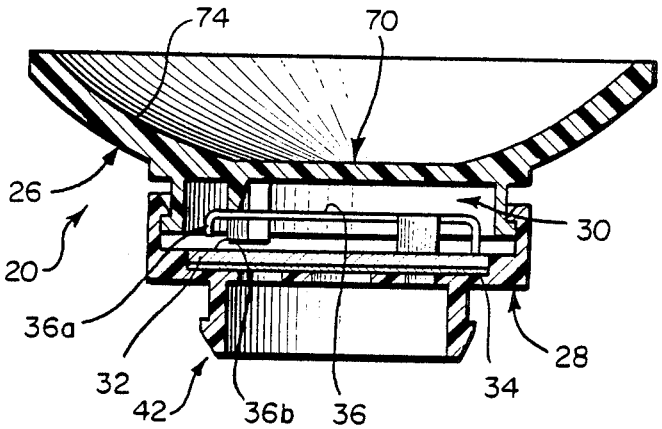
FIG. 3 is a sectional view taken substantially in the plane of line 3—3 of FIG. 1 showing the music module contained within an internal chamber of the knob.
Figure 4:
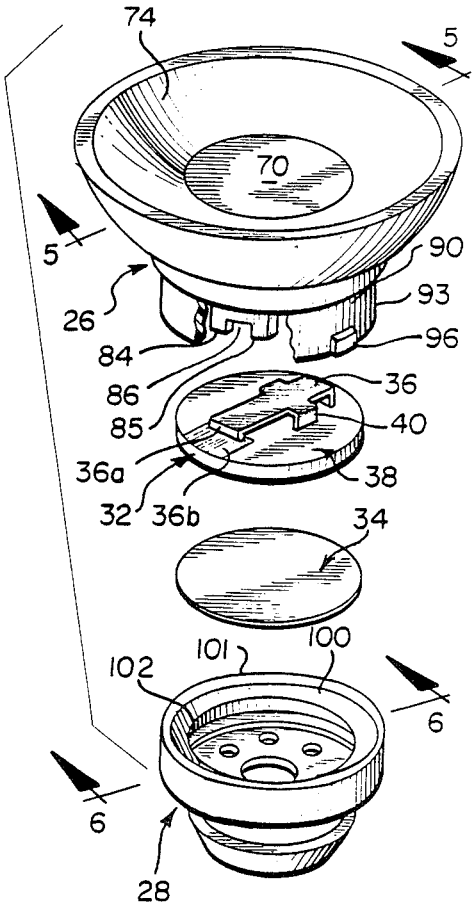
FIG. 4 is an exploded view of the novel knob.

Turning first to FIG. 1, there is shown a novel knob 20 containing a pressure activated electronic music module. As shown in FIG. 2, in the preferred embodiment, the knob 20 can be attached to a removable lid 22 of a container 24. In general, as shown in FIGS. 3 and 4, the knob can be thought of as a grip retainer comprising a top portion 26 and a bottom attachment portion 28 which cooperate in a registering relationship to form an internal chamber 30. Within the internal chamber 30, the knob 20 securely holds a music module 32 and an optional spacer member 34.

The module 32 has a flexible beam, bridge-like pressure bar member 36 on a top surface 38. In the preferred embodiment a small electric battery 40 is held between the bridge member 36 and the top surface 38. While only one battery is shown for illustration purposes, it will be understood that one skilled in the art could utilize more than one battery to increase the volume or life of the module. A downward force applied to the pressure bar 36 completes an electrical contact between a bar end **36*a* and a contact pad 36*b* on the top surface 38 which activates the music module. The module, with its battery and pressure bar, is of known conventional construction. In the preferred embodiment, the module 32** is manufactured by OKI Electric Company, 550-1 Higashiasakawa-Cho, Hachioji-Shi, Tokyo 193, Japan. The modules are programmed during the manufacturing process to play a preselected tune.

Figure 6:
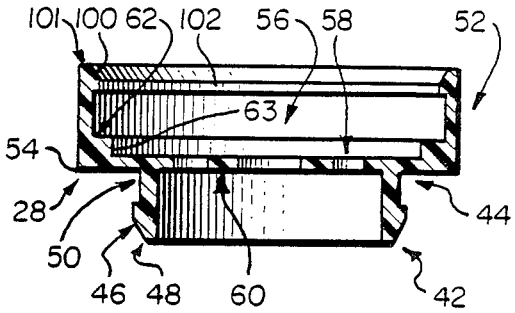
FIG. 6 is a sectional view taken substantially in the plane of line 6—6 of FIG. 4 showing a bottom portion of the novel knob.
Figure 7:
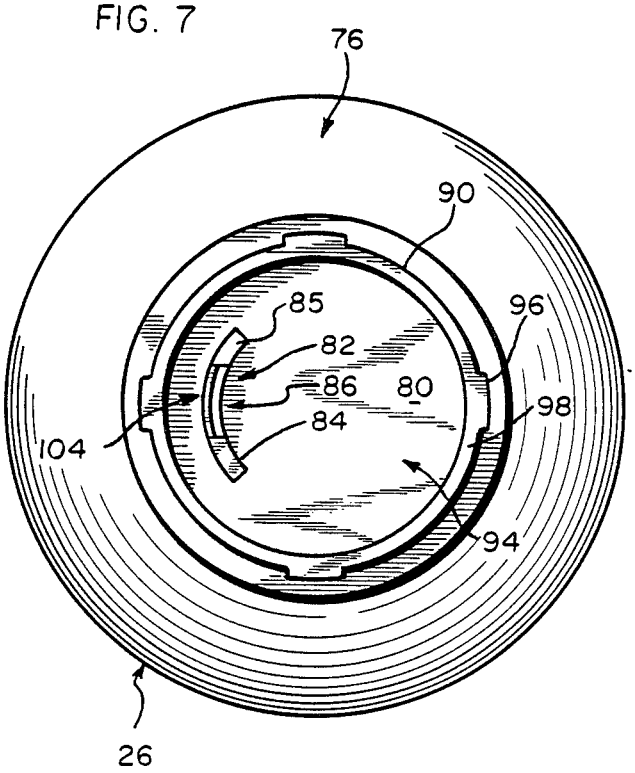
FIG. 7 is a bottom plan view of the knob top portion.
Figure 8:
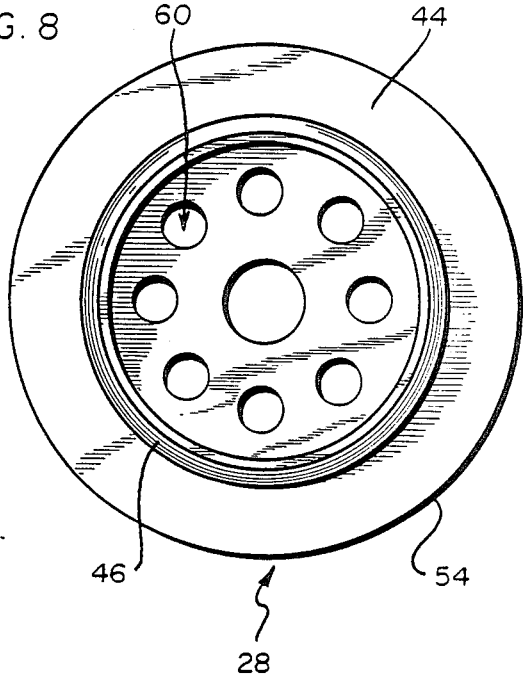
FIG. 8 is a bottom plan view of the knob bottom portion.

Turning now to FIGS. 6–8 there is shown the bottom attachment portion 28, which may be constructed from plastic or hard rubber. The bottom attachment portion 28 has a lid connector portion 42 extending downward from a circular outside bottom surface 44. An attachment rim member 46 projects outward from the lid connector portion parallel to the outside bottom surface adjacent a distal end 48 of the lid connector portion to define a throat member 50 between the attachment rim 46 and the outside bottom surface 44. The attachment rim member 46 tapers inward toward the distal end to provide a beveled surface for insertion of the lid connector portion 42 into an opening (not shown) in a container lid 22. The throat 50 is of sufficient length to allow the attachment rim member to penetrate through the container lid 22 and to lock onto an interior surface (not shown) of the container lid.

An annular wall member 52 projects upward from an outer edge 54 of the circular outside bottom surface 44 to define a receiving chamber 56 having an interior bottom surface 58. A plurality of apertures are formed in the interior bottom surface 58 to provide a means for sounds generated by the module 32 to be communicated out from the chamber 30 as will be described below.

A continuous step member 62 is formed integrally with the interior bottom surface 58 adjacent to the outer edge of the interior bottom surface 63. The step member 62 is designed to limit the lateral movement of both the music module 32 and optional spacer member 34 within the receiving chamber 56. While the module 32 may be superposed directly on the bottom surface when the spacer member 34 is not utilized, in the preferred embodiment the spacer member 34 is first superposed on the interior bottom surface 58 within the limiting confines of the step member 62. The music module 32 is then placed atop the spacer member 34 and is also confined in its lateral movement by the step member 62 which forms an outer boundary for both the spacer member and the module. While the spacer member may be constructed of any lightweight, nonporous, inexpensive material, in the preferred embodiment the spacer member is made of paper. The purpose of the spacer member is to prevent material contained in the canister 24 from entering the internal chamber 30. However, a conventional photocell activator could be formed as a spacer member. When the lid is removed from the container in the presence of a light source the photocell activator provides a means of activating the music module.

Figure 5:
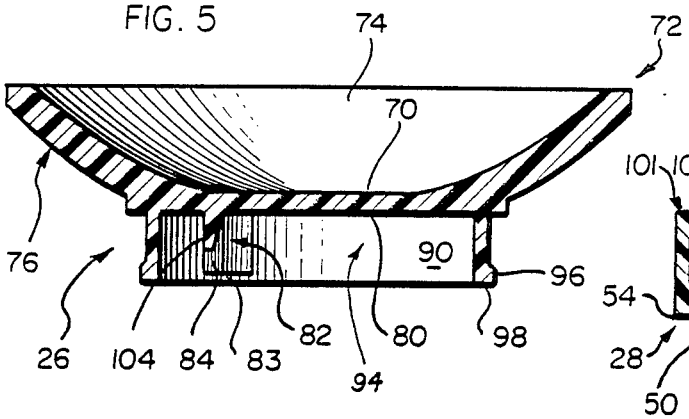
FIG. 5 is a sectional view taken substantially in the plane of line 5—5 of FIG. 4 showing a top portion of the novel knob.

Turning now to FIGS. 5 and 7, there is shown the top pressure receiver portion 26. It is constructed of a semi-rigid material, such as plastic or hard rubber, which resists deforming under an ordinary hand-applied pulling pressure. A center region, or pressure pad 70, could be constructed of a flexible material which deforms under ordinary thumb-applied pressure to transfer the pressure to the music module pressure bar. However, in the preferred embodiment the pressure pad is constructed from the same material as the rest of the pressure receiver portion.

In the preferred embodiment, illustrated in FIG. 5, the pad 70, located in the top center of the top pressure receiver portion, forms the bottom of a bowl 72 having a flange wall 74 extending outward and upward from the pad 70. The flange wall forms a rim 76 of sufficient thickness to remain rigid under the pulling pressure applied on opposite sides of the rim by a user's middle finger and forefinger as will be explained below. It will be understood that the receiver portion 26 can be provided in configurations other than the small bowl-like device illustrated here.

Integral with and extending downward from an internal pressure pad face 80 is a pressure transfer portion forming a rib member 82. At the rib member distal end 83 are two post members 84, 85, and a notch 86 is formed between them. A connector member 90, also integral with and extending downward from the internal pressure pad face 80, surrounds the rib member 82. The connector member 90 defines a cooperating top receiving chamber 94. A plurality of bosses 96 project outward adjacent the circular connector member distal edge 98. In the preferred embodiment there are four such projecting bosses equally spaced around the circumference of the circular connector member 90. When the connector member 90 is inserted into the receiving chamber 56 both the receiving chamber 56 and the cooperating top receiving chamber 94 join together in a registering relationship to form the internal chamber 30 containing the spacer member 34 and the music module 32 within.

As illustrated in FIG. 6, a holding rim 100, forming a distal end 101 of the receiving chamber 56 has a projecting shoulder member 102 which serves to prevent the projecting bosses 96 from being withdrawn from the receiving chamber 56. The bosses 96 cooperate with the holding rim 100 to securely hold the top pressure receiver portion 26 to the bottom attachment portion 28. The connector member 90 is arranged and configured to maintain a sliding relation with the receiving chamber 56, sliding between an unactivated first position, shown in FIG. 3, and an activated second position, shown in FIG. 1, as will be explained below.

When the top receiving chamber 94 is joined with the receiving chamber 56, the rib member 82 is positioned adjacent to and resting on the module pressure bar 36. The posts 84, 85 pass on either side of the module pressure bar 36 to receive the module pressure bar 36 within the notch 86 formed between the posts 84, 85 as shown in FIG. 3. In this, the unactivated first position, the pressure bar end **36*a* does not make contact with the contact pad 36*b*. When pressure is applied to the pad 70, the pad member 70 moves downward as the connector member slides in relation to the receiving chamber. As the pressure pad continues downward, the rib member 82, contacting the module pressure bar 36 at the notched contact surface 104, transfers the pressure applied to the pressure pad 70 to the module pressure bar 36. Under this pressure, the pressure bar deforms until bar end 36*a* contacts pad 36*b* to activate the music module 32. The post members 84, 85, positioned on either side of the pressure bar 36 are specially designed to protect the pressure bar 36 from damage. As pressure is applied to the pressure pad 70, the pressure pad moves downward until the posts 84, 85, contact the module top surface 38 in the activated second position. Contact between the posts 84, 85, and the module top surface 38 prevent any further downward movement of the pressure pad. The pressure bar 36**, positioned between the two posts receives sufficient pressure to activate the music module while being protected from any excess pressure.

When the downward pressure is removed from the pressure pad, the flexible beam pressure bar returns to its original position breaking contact between bar end **36*a* and pad 36*b***. The pressure bar is arranged to be of sufficient resilient strength to force the connector member backup to the unactivated first position.

In the preferred embodiment, as illustrated in FIG. 2, the knob 20 containing the music module 32 is attached to a removable lid 22 which is in turn placed on its mating canister 24. A forefinger and a middle finger of a user's hand (not shown) are placed on opposite sides of the pressure receiver rim 76. An upward pressure is then applied to the knob 20 by the forefinger and middle finger to pull the removable lid 22 from the mating canister 24 without activating the music module.

To activate the music module, the user need only apply a pressure, such as a user's thumb, to the pressure pad 70. In this manner, the music module 32 can be activated without the lid 22 being removed from the mating canister 24. When activated, the music module 32 produces sound which is communicated out of the internal chamber 30 by way of the apertures 60 formed in the bottom surface 58.

The user may also choose to activate the music module and remove the lid 22 from the mating cannister 24. This can be accomplished by placing the forefinger and middle finger on opposite sides of the pressure rim 76 and first applying a downward force on the pressure pad with a user's thumb, then applying an upward force on the pressure rim with the user's fingers. The upward pressure by the user's forefinger and middle finger removes the container lid from the canister while the thumb pressure, first applied to the pressure pad, activates the music module. In this manner the user can select the function the knob is to perform either individually or in combination.

What is claimed is:

1. A knob for attachment to a container comprising:

a top portion and a bottom portion, said portions joining together in a registering relationship and forming an internal chamber, wherein hand pressure applied to said top portion causes said top portion to move downward relative to the bottom portion, said top portion overhanging said bottom portion and providing a gripping area;

a selectively activatable electronic music module located in said internal chamber, having a flexible pressure bar attached at one end to said music module;

a contact pad on said music module located at the opposite end of the pressure bar from its point of attachment, said pressure bar being spaced above said pad, wherein said downward movement of said top portion causes contact between said pressure bar and said pad, activating said music module.

2. A knob as in claim 1 further comprising a lid connector portion arranged and configured on said bottom portion to securely mount the knob to a container wherein a portion of said lid connector portion penetrates through the container and locks onto an interior surface of the container.

3. A knob as in claim 1 wherein said internal chamber has a surface containing a plurality of apertures formed therein.

4. A knob as in claim 1 wherein said top portion of said knob is shaped like a concave bowl.

5. A knob as in claim 1 further comprising a rib member having a distal end adjacent to said pressure bar and a proximate end attached to an internal surface of said internal chamber, such that pressure applied to said top portion forces the rib member to contact said pressure bar against said contact pad to activate said music module.

6. A knob as in claim 5 wherein said distal end of said rib member has two projecting posts defining a notch formed therebetween, the distal end being arranged and configured to receive said pressure bar between the posts, wherein said posts limit pressure on said pressure bar by contacting a surface of said music module when a maximum pressure is applied to said pressure pad thereby limiting downward movement of said top portion.

* * * * *